US005771636A

United States Patent [19]

Mathis

[11] Patent Number: 5,771,636

[45] Date of Patent: Jun. 30, 1998

[54] SECURE SWING GATE SYSTEM THAT PROVIDES FREE ACCESS WHEN POWER IS OFF

[76] Inventor: Calvin Franklin Mathis, 10755 Artesia Blvd., Cerritos, Calif. 90703

[21] Appl. No.: 632,350

[22] Filed: Apr. 10, 1996

[51] Int. Cl.[6] ..... E05F 15/04

[52] U.S. Cl. ..... 49/139; 49/137; 49/138

[58] Field of Search ..... 49/136, 137, 138, 49/139, 35, 141, 32; 16/48.5, 52, DIG. 7

[56] References Cited

U.S. PATENT DOCUMENTS

| | | | |
|---|---|---|---|
| 2,298,542 | 10/1942 | Potter et al. | 49/137 |
| 2,371,450 | 3/1945 | Langdon | 49/137 |
| 2,586,442 | 2/1952 | Seagren | 49/137 |
| 2,606,002 | 8/1952 | Vander Veer et al. | 49/137 |
| 2,618,365 | 12/1952 | Seagren | 49/137 |
| 3,043,277 | 7/1962 | Carlson | 49/137 |
| 3,478,468 | 11/1969 | Martin | 49/137 |
| 3,534,500 | 10/1970 | Boehm et al. | 49/137 |
| 3,602,260 | 8/1971 | Boehm et al. | 49/137 |
| 3,699,717 | 10/1972 | Hedrick | 39/137 |
| 3,936,977 | 2/1976 | Runfit et al. . | |
| 4,330,958 | 5/1982 | Richmond . | |
| 4,490,068 | 12/1984 | Dickerson . | |
| 4,497,135 | 2/1985 | Vetter | 49/137 |
| 4,638,597 | 1/1987 | Lybecker . | |
| 4,796,358 | 1/1989 | Tyler . | |
| 4,818,136 | 4/1989 | Nasatka . | |
| 4,995,194 | 2/1991 | Schultze et al. | 49/137 |
| 5,018,687 | 5/1991 | Kupfernagle et al. . | |
| 5,136,810 | 8/1992 | Dewill III . | |

*Primary Examiner*—Blair Johnson
*Assistant Examiner*—Curtis Cohen
*Attorney, Agent, or Firm*—Howard A. Kenyon

[57] ABSTRACT

A swing gate providing free access when the electrical power that drives a hydraulic system to open and close the gate is off is described. The hydraulic system comprises a reversible electrical motor to drive a hydraulic pump which in turn provides hydraulic fluid under pressure to a double acting hydraulic actuator. An electrical actuated solenoid valve is located in a bypass line of the hydraulic system and the solenoid valve is designed to open when the electrical power is off which allows the hydraulic fluid to drain from one side of the actuator into a reservoir. Since one side of the double acting actuator contains no fluid under pressure, the swing gate can be opened by hand.

6 Claims, 2 Drawing Sheets

SECURE SWING GATE SYSTEM THAT PROVIDES FREE ACCESS WHEN POWER IS OFF

BACKGROUND OF THE INVENTION

1. Field of the Invention

This invention relates to a system that allows a hydraulically operated gate to be opened by hand when power is lost.

2. Description of the Prior Art

Swing gates are often used to permit access to an industrial and residential enclosed areas. Many of these gates utilize a powered system to open and dose the gates. Sometimes the powered system is hydraulic power and the gate when closed cannot be opened against a cylinder containing hydraulic fluid and therefore provides a degree of security which does not require a separate locking device.

Some fire and police departments in the State of California use a Knox system which is a secure box utilizing a special key that allows a gate to be opened when the power is on. If a catastrophic situation is present and the power is off that runs the hydraulic system, there is no way that a person can get inside to tend to an emergency situation in the enclosed area. The procedure in the past has been to ram the gate to gain access to the yard. This is very expensive as it destroys the gate and the specific vehicle is often not designed to ram gates. Therefore, time is lost by obtaining a proper vehicle to ram the gate.

There are no designs that are directed to a swing gate system that allows free access when the power is off. What is needed is a system that allows a person to move the gate from a closed position to an open position merely by hand.

Accordingly, a fuller understanding of the invention may be obtained by referring to the summary of the invention and the detailed description of the preferred embodiment, in addition to the scope of the invention defined by the claims taken in conjunction with the accompanying drawings.

SUMMARY OF THE INVENTION

It is the object of the present invention to provide a hydraulic system to open and close a swing gate.

It is another object of the present invention to provide a solenoid valve in a bypass line of the hydraulic system.

It is yet another object of the present invention to close the solenoid valve when the solenoid valve is electrically powered.

It is still another object of the present invention to provide the solenoid valve to open and drain hydraulic fluid to the reservoir when the electrical power is off.

Briefing, in accordance with the present invention, there is provided a swing gate having a hydraulic system to open and close the gate. The gate is secured to a fixed structure by hinges and the hydraulic system utilizes a double acting hydraulic cylinder to open and close the gate. The hydraulic system also utilizes a reversible motor which drives a hydraulic pump which in turn supplies hydraulic fluid under pressure to either side of the double acting hydraulic cylinder. A solenoid valve is located in the bypass hydraulic line that closes the gate. When the power is off, a spring bias opens the solenoid valve. When the gate is to be opened by hand the hydraulic fluid in the side of the double acting cylinder that closes the gate, drains back into the reservoir.

The novel features which are believed to be characteristics of the invention, both as its organization and its method of operation, together with further objects and advantages thereof, will be better understood from the following description in connection with the accompanying drawings in which a presently preferred embodiment of the invention is illustrated by way of example. It is to be expressly understood, however, that the drawings are for purposes of illustration and description only, and are not intended as a definition of the limits of the invention.

BRIEF DESCRIPTION OF THE DRAWINGS

In the drawings which illustrates the best mode presently contemplated for carrying out the present invention.

DETAILED DESCRIPTION OF THE PREFERRED EMBODIMENT

Figure 1:
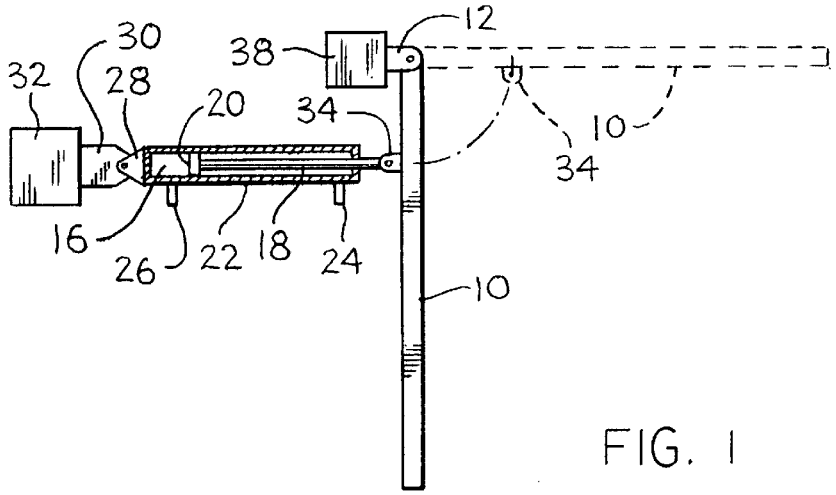
FIG. 1 shows a top view of a swing gate in an open position with the dash lines in a closed position.

Turning now to FIG. 1 there is shown a top view of a swing gate 10 in the open position. The gate 10 is shown in dotted lines in the closed position. Gate 10 has at least two hinges attached (not shown). The other part of the hinges 12 is permanently attached to a fixed structure 14 which in the present case is a post. A double acting cylinder 16 is shown as a partial cut away drawing. Cylinder 16 contains a rod 18, a piston 20 and a casing 22. The fluid ports to casing 22 are shown as 24 and 26 respectively. The cylinder 16 has a fitting 28 on one end attached to another fitting 30 which is permanently attached to a fixed structure 32 which in the present case is a post. The other end of the cylinder rod 18 is attached to a fitting 34 which in turn is attached to gate 10.

Figure 2:
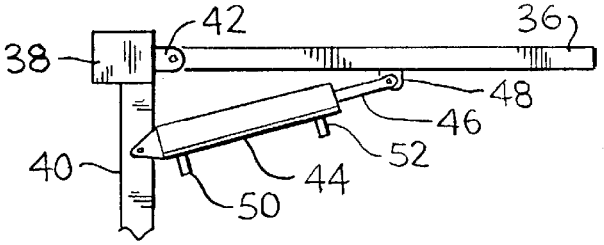
FIG. 2 shows a top view of a swing gate in a closed position where there is limited access to a fixed structure.

FIG. 2 shows a similar gate that is configured where there is no space for a fixed structure as shown in FIG. 1. FIG. 2 shows a gate 36, fixed structure 38 with plate 40 attached to fixed structure 38. Fitting 42 is also attached to fixed structure 38. Gate 36 also has at least two hinges (not shown). FIG. 2 also shows casing 44 attached to plate 40. Piston rod 46 is attached to gate 36 by fitting 48. The fluid ports to casing 44 are also shown in this view as 50 and 52.

Figure 3:
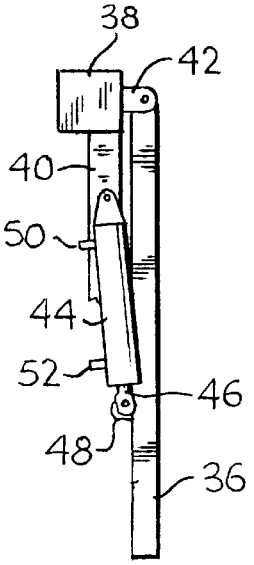
FIG. 3 is a top view of FIG. 2 in an open position.
Figure 4:
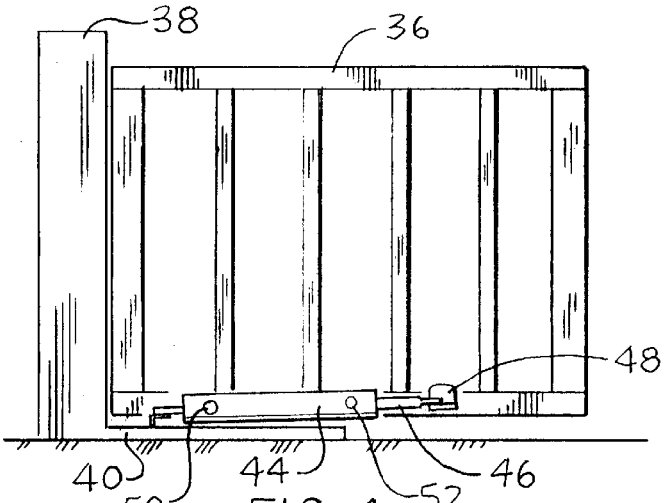
FIG. 4 is a front view of FIG. 3 in an open position.

FIG. 3 shows a top view of the gate shown in FIG. 2 in an open position and FIG. 4 shows a side view of the gate of FIG. 3.

Figure 5:
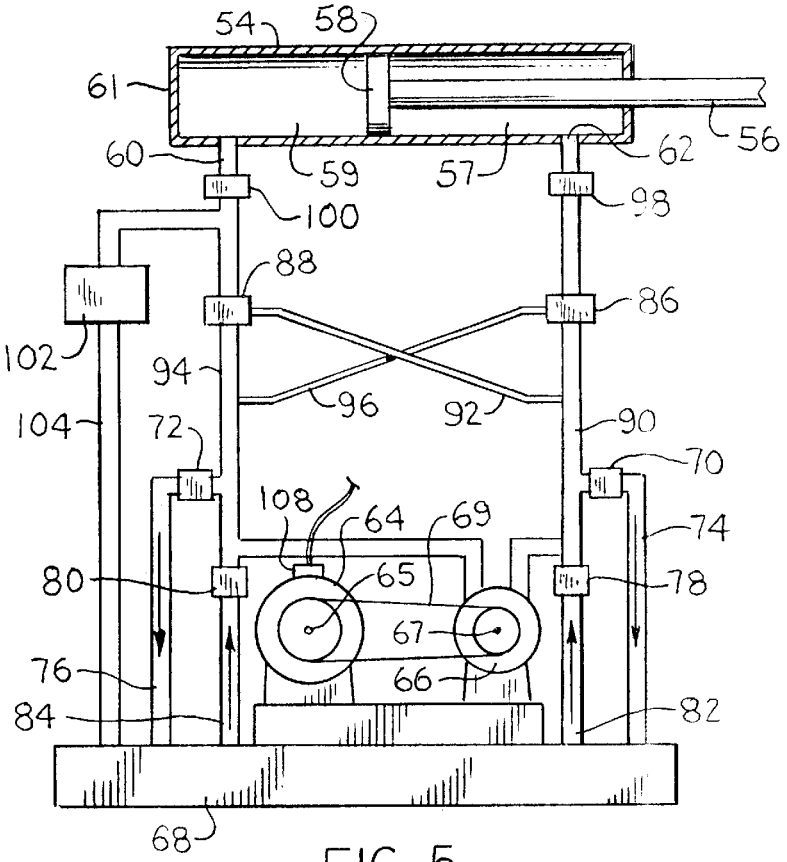
FIG. 5 is a drawing of a hydraulic system.

Turning now to FIG. 5 there is seen a hydraulic system designed to open the gates shown in FIGS. 1 and 2. In FIG. 5 there is seen a piston casing 54, piston rod 56, and piston 58 shown in a partial cut away drawing. Fluid ports 60 and 62 are also shown in this view that provides fluid passage into cavities 57 and 59. The hydraulic system has a reversible motor 64, a hydraulic pump 66 and a belt 69 between motor 64 and pump 66. The diameter of pulleys 65 and 67 can be changed to provide a change in flow rate and therefor a change in swing rate of the gate. The preferred swing rate depends on the length of the gate and the weight of the gate. FIG. 5 also shows a hydraulic fluid reservoir 68 to hold the hydraulic fluid. An adjustable pressure check valve 70 is shown in the bypass line 74 to regulate the hydraulic pressure required for the desired opening swing rate. A preset check valve 72 is shown in the bypass line 76 that controls the closure swing rate. The adjustable pressure check valve 70 allows the swing rate to be customized to a specific demand, while a closure swing rate uses a preset check valve when a specific closure rate is not required. A preset pressure check valve is less costly than an adjustable pressure check valve. The hydraulic fluid in lines 74 and 76 flow back into reservoir 68. Check valves 78 and 80 are in lines 82 and 84 to ensure that the hydraulic fluid under pressure will go to the ports 60 or 62. Pilot operated check valve 86 is configured such that when pressure is in line 90, pressure is also in line 92 which opens the check valve 88 so fluid from cavity 59 is free to return to reservoir 68 through line 94, relief valve 72 and line 76. Similarly, pilot operated check valve 88 is configured such that when pressure is in line 94, pressure is also in line 96 which opens check valve 86 so fluid from cavity 57 is free to return to reservoir 68 through line 90, relief valve 70 and line 74. Pressure switches 98 and 100 are provided in lines 90 and 94 to shut off the motor 64 when the pressure increases due to full travel or an obstruction in the path of the gate. It should be noted that the hydraulic system described in FIG. 5 is described for clarity and the actual combination of elements will be packaged in a different manner. A solenoid valve 102 is spring biased and is magnetically closed during normal operation of the gate. If the power goes off, the spring in the solenoid valve 102 will cause the valve to open. This allows the hydraulic fluid in cavity 59 to drain through solenoid valve 102, line 104, and into reservoir 68. The need to drain fluid from cavity 59 will occur when piston 58 moves towards the end of cylinder 61. This will occur when the gate 10 or 36 is hand operated from the closed to the open position.

Figure 6:
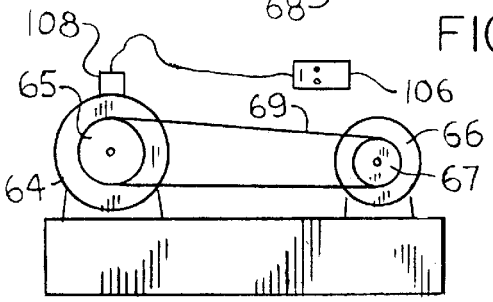
FIG. 6 is a side view of the motor-pump assembly.

FIG. 6 shows the reversible motor 64 and a remote control 106 and the signal receiver 108 which can turn the power on to energize the motor in the desired direction. Also seen is hydraulic pump 66, pulleys 65 and 67 and belt 69.

Figure 7:
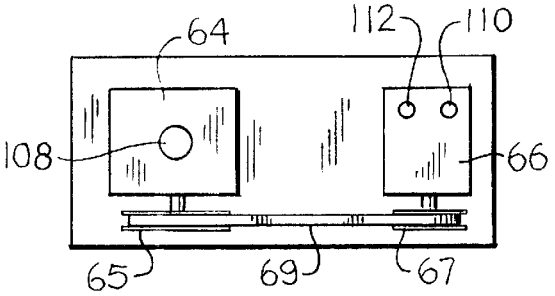
FIG. 7 is a top view of the motor-pump assembly.

FIG. 7 is a top view of FIG. 6 showning the hydraulic fluid openings 110 and 112, motor 64, hydraulic pump 66, signal receiver 108, pulleys 65 and 67 and belt 69.

Figure 8:
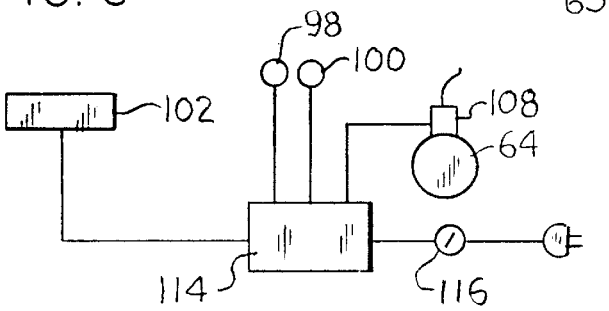
FIG. 8 is a drawing of the of the wiring required for the present gate system.

FIG. 8 shows an electrical wiring diagram that provides power to the solenoid valve 102, motor 64, and pressure switches 98 and 100. A junction box 114 distributes the power and a key switch 116 is also seen in this view.

Thus, it is apparent that there has been provided in accordance with the invention, a swing access gate system that fully satisfies the objectives, aims, and advantages set forth above. While the invention has been described in conjunction with specific embodiments thereof, it is evident that many alternatives, modifications, and variations will be apparent to those skilled in the art in light of the aforegoing description. Accordingly, it is intended to embrace all such alternatives, modifications, and variations that fall within the spirit as scope of the appended claims.

What is claimed is:

1. A gate opening and closing apparatus comprising:

a gate swinging in a horizontal direction;

at least two hinges, said hinges having first ends and second ends, said first ends attached to one end of said gate;

a fixed structure, said second ends of said hinges attached to said fixed structure;

a key operated control switch;

a reversible electric motor with control sensing to supply power to a hydraulic pump;

a remote control device to provide a signal to said control sensing;

a hydraulic pump to supply hydraulic pressure;

a hydraulic reservoir to hold hydraulic fluid;

a double acting hydraulic cylinder to move said gate, said double acting cylinder having a rod, a piston connected to said rod and a casing, said rod being attached to said gate and said casing being attached to a fixed structure;

means to open said gate without said hydraulic power means;

check valves to prevent flow of hydraulic fluid to said hydraulic reservoir;

relief valves to control hydraulic pressure;

pilot operated check valves to open said check valve when required to allow hydraulic fluid to drain from said double acting hydraulic cylinder;

pressure switches to shut off power to said reversible electric motor, said pressure switches being activated at full open or closed position or when encountering an obstruction;

A solenoid valve to close by electrical power and open by spring biased means.

2. A gate opening and closing apparatus as described in claim 1 wherein said hydraulic pump provides hydraulic fluid under pressure to one side of said double acting cylinder wherein said reversible motor turns in one direction and said hydraulic pump provides hydraulic fluid under pressure to the other side of said double acting hydraulic cylinder when said reversible motor turns in the other direction.

3. A gate opening and closing apparatus as described in claim 1 wherein said solenoid valve is located in a bypass of a return line of said double acting cylinder.

4. A gate opening and closing device as described in claim 3 wherein said solenoid valve is open when said electrical power is turned off allowing said hydraulic fluid in said double acting cylinder to drain into said reservoir and said gate can be opened by hand.

5. A gate opening and closing device as described in claim 1 wherein the flow rate of said hydraulic fluid by said hydraulic pump governs the swing rate of said gate.

6. A gate opening and closing device as described in claim 1 wherein said pressure switches are installed in the opening pressure line and closing pressure line and will shut off the electrical power to the reversible electric motor if the pressure in either the opening or closing line exceeds that required to move said gate.

* * * * *